US007984808B1

(12) United States Patent
Lai

(10) Patent No.: US 7,984,808 B1
(45) Date of Patent: Jul. 26, 2011

(54) ROLLING PAINTING FRAME

(75) Inventor: Eddy Lai, Kowloon Bay (HK)

(73) Assignee: Red Point Paper Products Co., Limited, Kowloon Bay, Kowloon (HK)

( * ) Notice: Subject to any disclaimer, the term of this patent is extended or adjusted under 35 U.S.C. 154(b) by 0 days.

(21) Appl. No.: 12/902,451

(22) Filed: Oct. 12, 2010

(51) Int. Cl.
*B65D 69/00* (2006.01)
*B05C 17/00* (2006.01)

(52) U.S. Cl. ..... 206/575; 206/1.7

(58) Field of Classification Search ..... 206/1.7–1.9, 206/45.24, 45.25, 449, 575; 312/231, 237, 312/330.1, 334.21
See application file for complete search history.

(56) References Cited

U.S. PATENT DOCUMENTS 3,352,616 A * 11/1967 Linger ..... 312/231
4,372,630 A * 2/1983 Fuhri ..... 312/231
5,351,812 A * 10/1994 Eagon ..... 206/1.7
5,388,689 A * 2/1995 Kroop et al. ..... 206/1.7
6,619,474 B2 * 9/2003 Montgomery ..... 206/1.9
7,694,806 B2 * 4/2010 Huggins ..... 206/1.7

* cited by examiner

*Primary Examiner* — Luan K Bui
(74) *Attorney, Agent, or Firm* — Raymond R. Ferrera; Adams and Reese LLP

(57) ABSTRACT

Present patent relates to a rolling painting frame, comprising a box (1) having an opening, a scroll mechanism (2) mounted in said box (1) and a slidable drawer (3) mounted in said box (1), said box (1) comprises a bottom surface (100), an opening surface (101) opposite to said bottom surface (100) and four side surfaces; among the four side surfaces, a first side surface (102) has two mounting holes (103) on it; said scroll mechanism (2) comprises two rotary rollers (200) mounted side by side in said two mounting holes (103) respectively and a painting paper (201) which connects said two rotary rollers (200) and seals said opening of the box (1). The rolling painting frame can realize successive painting without changing the painting paper (201) frequently, it's very convenient for users to place related tools into the drawer and adjust the angle of the rolling painting frame so as to draw more comfortable.

10 Claims, 3 Drawing Sheets

ROLLING PAINTING FRAME

TECHNICAL FIELD

Present patent relates to a painting tool, in particular a box-like rolling painting frame with a drawer which can accommodate items.

TECHNICAL BACKGROUNDS

As we know, when painting, papers, plates, kinds of pens and pigments and etc. are needed. The existing painting board is foldable; users need to set up the painting board before painting. And the existing painting board painting paper and kinds of pens and pigments are placed respectively, it's very inconvenient for the user to carry about. If the user wants to draw more paintings, he has to change the painting paper frequently.

DESCRIPTION OF PRESENT PATENT APPLICATION

In order to solve the problem of inconvenience to carry about and use, a rolling painting frame is provided in present patent.

The solution to solve the problem is to provide a rolling painting frame, which comprises a box having an opening a scroll mechanism sealing said opening of the box and a drawer slidable in said box; said box comprises a bottom surface, an opening surface opposite to said bottom surface and four side surfaces; among the four side surfaces, a first side surface has two mounting hole, said scroll mechanism comprises two rotatable rollers mounted side by side in two said mounting holes respectively and a painting paper which connects said two rotary rollers and seals said opening.

In present patent of the rolling painting frame, one end of said painting paper is fixed on one of said rollers, the other end is fixed on the other roller, said painting paper can cover up said opening surface completely;

the length of said rollers is greater than the length of the box, the width of the painting paper is greater than the length of said opening surface and less than the length of the box, the length of said painting paper is greater than the width of said box, the width of said opening surface is less than the space of the axle centers between said two rollers.

In present patent of the rolling painting frame, above said two rollers is a positioning board which is used for sealing said opening surface, said painting paper covers up said positioning board, said positioning board is located between said painting paper and said rollers, a drawer box one of whose ends is open is fixed at the bottom of said positioning board, there is a drawer opening between said two mounting holes which is jointed to the opening end of said drawer box, said drawer is mounted into said drawer box by sliding through said drawer opening and said opening end of the drawer box.

In present patent of the rolling painting frame, said the width of said positioning board is greater than the distance between said two rollers, the length of said positioning board is no less than the width of said painting paper.

In present patent of the rolling painting frame, said drawer comprises a door, the size of said opening end of said drawer box is equal to the size of said drawer opening, the length and width of the door are respectively greater than that of said drawer box, a hilt is fixed on the outer surface of said door.

In present patent of the rolling painting frame, said rolling painting frame further comprises a handle mounted in said box, said handle comprises two fasteners and a handle body which is rotatably mounted between said two fasteners, one end of said fasteners is fixed on said box, the other end of said fasteners are fixed with two ends of said rotatable handle body respectively.

In present patent of the rolling painting frame, said fasteners are respectively fixed on a second side surface.

In present patent of the rolling painting frame, said fasteners are respectively fixed on a third side surface.

In present patent of the rolling painting frame, said fasteners are respectively fixed on a fourth side surface.

In present patent of the rolling painting frame, a bracket is mounted on the outer part of said box, said bracket comprises a fixed retaining plate and two supports which are respectively mounted rotatably on each side of said retaining plate, and said retaining plate is fixed on the outer part of said bottom surface.

The benefit by applying present patent lies in that:

1) The rotatable scroll mechanism helps users to paint successively without changing painting paper frequently.

2) The drawer helps users able to place painting tools into it without using other receptacle.

3) The handle on the painting frame brings convenience for users to carry about.

4) The bracket on the painting frame brings convenience for users to adjust the angle of the rolling painting frame so as to paint more comfortably.

DETAILS OF PRESENT PATENT

Figure 1:
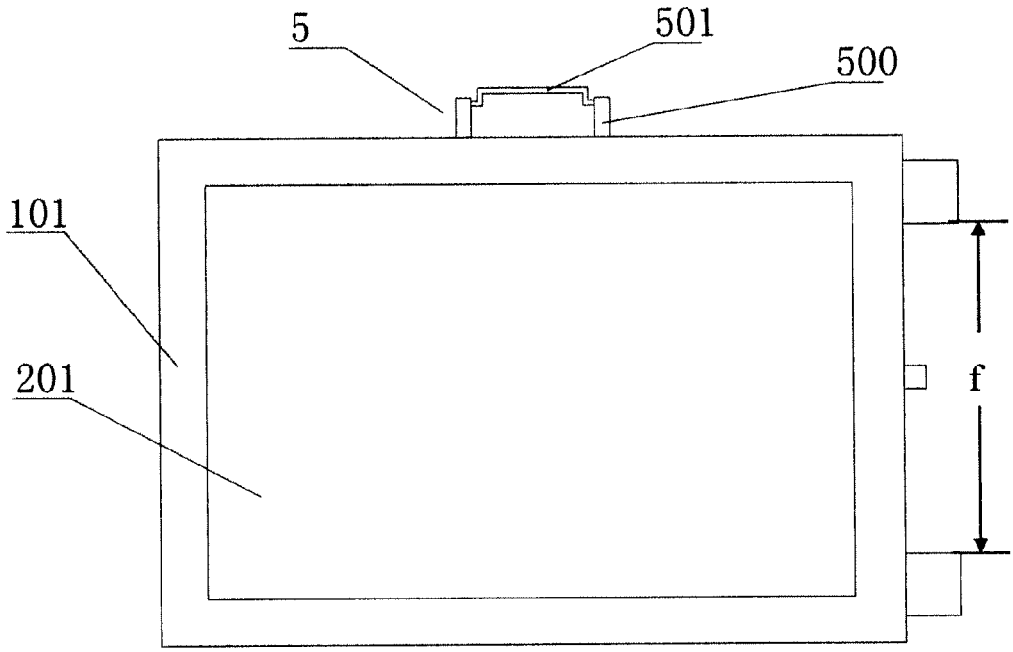
FIG. 1 is the front view of the rolling painting frame.
Figure 2:
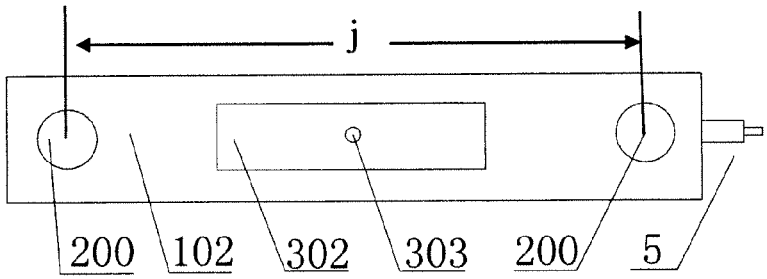
FIG. 2 is the left view of the rolling painting frame.
Figure 3:
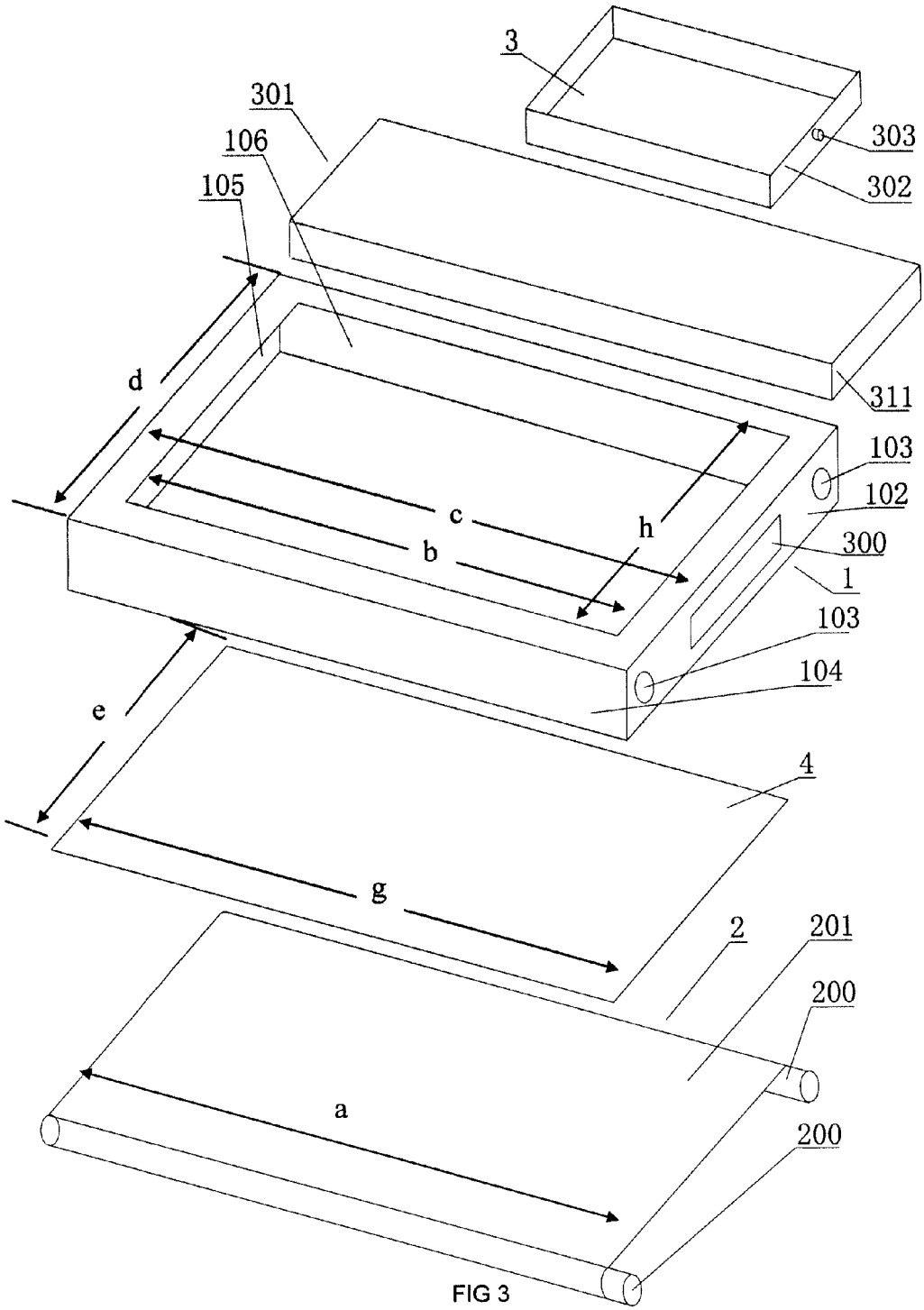
FIG. 3 is the exploded view of the rolling painting frame.
Figure 4:
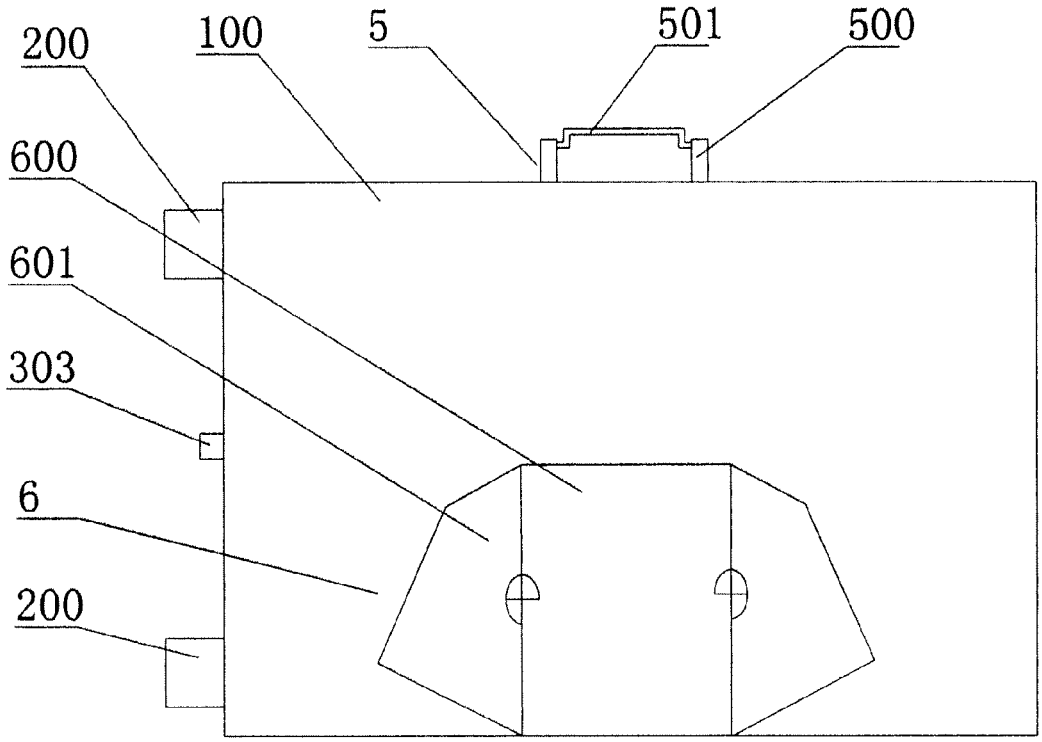
FIG. 4 is the back view of the rolling painting frame.

As shown in FIG. 1-4, present patent of a rolling painting frame comprises a box 1 having an opening, a scroll mechanism 2 mounted in box 1 used for painting and a drawer 3 used for placing pens, pigments and so on. The scroll mechanism 2 is mounted rotatably in the box 1, and the drawer 3 is also mounted in the box 1.

The box 1 comprises a bottom surface 100, an opening surface 101 which is opposite to the bottom surface 100 and four side surfaces. Among the four side surfaces, there is a first side surface 102 which on it has two mounting holes 103 and a drawer opening 300 between the two mounting holes 103. Underneath the box 1 is fixed a bracket 6 which is mounted on the outer surface of the bottom surface 100. The box 1 also comprises a handle 5, and the handle 5 is mounted on any one of side surfaces except the first side surface 102, that is to say, can be mounted on the second side surface 104 or the third side surface 105 or the fourth side surface 106.

The scroll mechanism 2 comprises two rotary rollers 200 side by side mounted in the two mounting holes 103 respectively and a painting paper 201 connecting the two rotary rollers 200. The painting paper 201 is rectangle, and two parallel side edges are fixed on the rollers 200 respectively. And the length of the rollers 200 is greater than the length c of the box 1, so one end of the rollers 200 is outside the box 1.

The painting paper 201 is rolled up on the rollers 200, the opening surface 101 comprises at least one open and the opens are between said two rollers 200, the painting paper 201 covers up the opens. The width a of the painting paper 201 is greater than the length b of the opening surface 101 and less than the length c of the box 1, the length of the painting paper 201 is greater than the width d of the box 1, and the width h of the opening surface 101 is less than the distance h of the axle centers between said two rollers 200.

There is a positioning board 4 above the two rollers 200 for use of covering up the opening surface 101, the painting paper 201 covers up the positioning board 4 which is fixed between the painting paper 201 and the rollers 200. A drawer box 301 with an opening end is fixed on the bottom of the positioning board 4, and the opening end 311 of the drawer box 301 is jointed to the drawer opening 300, the drawer 3 is mounted into the drawer box 301 by sliding through the drawer opening 300 and the opening end 311 of the drawer box 301. The width e of the positioning board 4 is greater than the distance f between the two rollers 200, the length g of the positioning board 4 is no less than the width of the painting paper 201.

The drawer 3 comprises a door 302; the opening end 311 of the drawer box 301 has the same size with that of the drawer opening 300. In this embodiment, the width and length of the door 302 are respectively greater than that of the drawer opening 300, there is a hilt 303 fixed on the outer surface of the door 302.

The handle 5 in this embodiment comprises two fasteners 500 and a rotating handle body 501 which is mounted between the two fasteners 500, one end of the fasteners 500 is fixed on the box 1, the other ends of the two fasteners 500 is fixed with both ends of the rotatable handle body 501 respectively. The fasteners 500 are fixed on one of the side surfaces of the box 1 except the first side 102. That means, the fasteners 500 can be fixed on the second side surface 104 or the third side surface 105 or the fourth side surface 106.

The bracket 6 in this embodiment comprises a retaining plate 600 fixed on the outer part of the bottom surface 100 and a supports 601 mounted rotatably on both sides of the retaining plate 600.

Users can place any painting tools in the drawer 3 and hold the handle 5 to carry the painting frame anywhere he wants to.

When painting, adjust the bracket 6 to a comfortable angle, rotate one of the rollers 200 so as to roll out blank portion of the painting paper 201 for painting, and then, take out the painting tools from the drawer 3. If the user wants to draw another painting after having finished present one, he just needs to rotate one of the rollers 200 again until another blank portion of the painting paper 201 appears.

While the patent has been illustrated and describe as embodied in a rolling painting frame, it is not intended to be limited to the detailed shown, various modifications and changes may be made without departing in any way from the spirit of the present patent.

The invention claimed is:

1. A rolling painting frame, comprises a box (1) having an opening, a scroll mechanism (2) sealing said opening of the box (1) and a drawer (3) slidable in said box (1); said box (1) comprises a bottom surface (100), an opening surface (101) opposite to said bottom surface (100) and four side surfaces; among the four side surfaces, a first side surface (102) has two mounting holes (103), said scroll mechanism (2) comprises two rotatable rollers (200) mounted side by side in two said mounting holes (103) respectively and a painting paper (201) which connects said two rotary rollers (200) and seals said opening.

2. A rolling painting frame according to claim 1, wherein one end of said painting paper (201) is fixed on one of said rollers (200), the other end is fixed on the other roller (200), said painting paper (201) can cover up said opening surface (101) completely;

the length of said rollers (200) is greater than the length (c) of the box (1), the width (a) of the painting paper (201) is greater than the length (b) of said opening surface (101) and less than the length (c) of the box (1), the length of said painting paper (201) is greater than the width (d) of said box (1), the width (h) of said opening surface (101) is less than the space (j) of the axle centers between said two rollers (200).

3. A rolling painting frame according to claim 1, wherein above said two rollers (200) is a positioning board (4) which is used for sealing said opening surface (101), said painting paper (201) covers up said positioning board (4), said positioning board (4) is located between said painting paper (201) and said rollers (200), a drawer box (301) one of whose ends is open is fixed at the bottom of said positioning board (4), there is a drawer opening (300) between said two mounting holes (103) which is jointed to the opening end (311) of said drawer box (301), said drawer (3) is mounted into said drawer box (301) by sliding through said drawer opening (300) and said opening end (311) of the drawer box (301).

4. A rolling painting frame according to claim 3, wherein said the width (e) of said positioning board (4) is greater than the distance (f) between said two rollers (200), the length (g) of said positioning board (4) is no less than the width (a) of said painting paper (201).

5. A rolling painting frame according to claim 4, wherein said drawer (3) comprises a door (302), the size of said opening end (311) of said drawer box (301) is equal to the size of said drawer opening (300), the length and width of the door (302) are respectively greater than that of said drawer box (301), a hilt (303) is fixed on the outer surface of said door (302).

6. A rolling painting frame according to claim 1, wherein said rolling painting frame further comprises a handle (5) mounted in said box (1), said handle (5) comprises two fasteners (500) and a handle body (501) which is rotatably mounted between said two fasteners (500), one end of said fasteners (500) is fixed on said box (1), the other end of said fasteners (500) are fixed with two ends of said rotatable handle body (501) respectively.

7. A rolling painting frame according to claim 6, wherein said fasteners (500) are respectively fixed on a second side surface (104).

8. A rolling painting frame according to claim 6, wherein said fasteners (500) are respectively fixed on a third side surface (105).

9. A rolling painting frame according to claim 6, wherein said fasteners (500) are respectively fixed on a fourth side surface (106).

10. A rolling painting frame according to claim 1, wherein a bracket (6) is mounted on the outer part of said box (1), said bracket (6) comprises a fixed retaining plate (600) and two supports (601) which are respectively mounted rotatably on each side of said retaining plate (600), said retaining plate (600) is fixed on the outer part of said bottom surface (100).

* * * * *